US009966058B2

(12) United States Patent
Sakaguchi

(10) Patent No.: US 9,966,058 B2
(45) **Date of Patent: *May 8, 2018**

(54) AREA-SOUND REPRODUCTION SYSTEM AND AREA-SOUND REPRODUCTION METHOD

(71) Applicant: PANASONIC INTELLECTUAL PROPERTY CORPORATION OF AMERICA, Torrance, CA (US)

(72) Inventor: Atsushi Sakaguchi, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/661,370

(22) Filed: Jul. 27, 2017

(65) Prior Publication Data

US 2017/0323629 A1 Nov. 9, 2017

Related U.S. Application Data

(63) Continuation of application No. 15/245,264, filed on Aug. 24, 2016, now Pat. No. 9,754,575.

(30) Foreign Application Priority Data

Aug. 31, 2015 (JP) ..... 2015-170332
Jun. 2, 2016 (JP) ..... 2016-110608

(51) Int. Cl.
*G10K 11/178* (2006.01)
*H04R 29/00* (2006.01)
(Continued)

(52) U.S. Cl.
CPC ..... *G10K 11/178* (2013.01); *H04R 1/403* (2013.01); *H04R 3/04* (2013.01); *H04R 29/002* (2013.01);
(Continued)

(58) Field of Classification Search
CPC ..... H04R 1/403; H04R 29/002; H04R 3/04; H04R 2201/403; H04R 2430/25;
(Continued)

(56) References Cited

U.S. PATENT DOCUMENTS 7,130,430 B2 10/2006 Milsap
8,000,170 B2 8/2011 Kablotsky
(Continued)

FOREIGN PATENT DOCUMENTS

JP 2010-011269 1/2010
JP 2015-231087 12/2015

OTHER PUBLICATIONS

Written Opinion, dated Dec. 22, 2016, for the corresponding European Patent Application No. EP16186466, published as EP3136746.

*Primary Examiner* — Brenda C Bernardi
(74) *Attorney, Agent, or Firm* — Greenblum & Bernstein, P.L.C.

(57) ABSTRACT

An area-sound reproduction system is provided that includes a speaker array having a plurality of speakers arranged side by side, a sound collector configured to collect an environment sound in an environment where the area-sound reproduction system is installed, a processor, and a memory having a computer program stored thereon. The computer program causes the processor to execute operations, including adjusting signals that the plurality of speakers are caused to output as reproduced sounds according to a reproduction condition on a control line, and causing the plurality of speakers to output the reproduced sounds.

15 Claims, 9 Drawing Sheets

(51) Int. Cl.

| | |
|---|---|
| ***H04R 3/04*** | (2006.01) |
| ***H04R 1/40*** | (2006.01) |
| *H04S 7/00* | (2006.01) |

(52) U.S. Cl.
CPC ..... *G10K 2210/3011* (2013.01); *G10K 2210/3028* (2013.01); *H04R 2201/403* (2013.01); *H04R 2430/25* (2013.01); *H04S 7/302* (2013.01)

(58) Field of Classification Search
CPC ..... G10K 11/178; G10K 2210/3011; G10K 2210/3028; G10K 11/175; H04S 7/302
See application file for complete search history.

(56) References Cited

U.S. PATENT DOCUMENTS

| | | | |
|---|---|---|---|
| 8,045,722 | B2 | 10/2011 | Choi et al. |
| 8,379,891 | B2 | 2/2013 | Tashev et al. |
| 8,965,546 | B2 | 2/2015 | Visser et al. |
| 2010/0142733 | A1 | 6/2010 | Choi et al. |
| 2013/0259254 | A1 | 10/2013 | Xiang et al. |
| 2014/0006017 | A1 | 1/2014 | Sen |
| 2014/0064526 | A1 | 3/2014 | Otto et al. |

AREA-SOUND REPRODUCTION SYSTEM AND AREA-SOUND REPRODUCTION METHOD

This is a continuation application of pending U.S. patent application Ser. No. 15/245,264, filed Aug. 24, 2016, which claims the benefit of Japanese Application Nos. 2016-110608, filed Jun. 2, 2016 and 2015-170332, filed Aug. 31, 2015. The disclosure of this document, including the specification, drawings, and claims, is incorporated herein by reference in its entirety.

1. TECHNICAL FIELD

The present disclosure relates to an area-sound reproduction system and an area-sound reproduction method.

2. DESCRIPTION OF THE RELATED ART

Conventionally, there are known area-sound reproduction techniques using multiple speakers to present a sound only at a specific position, or present different sounds at separate positions in the same space without the sounds being interfered with one another. The use of this technique can present the reproduced sounds of different contents or sound volumes to users. Japanese Unexamined Patent Application Publication No. 2010-11269 discloses a technique of adjusting reproduced sounds in accordance with a distribution of users based on positions of the users or the number of the users.

SUMMARY

However, a further improvement has been required, in the abovementioned conventional technique, for implementing the area-sound reproduction that allows the reproduced sounds to be appropriately adjusted in accordance with an environment sound.

In one general aspect, the techniques disclosed here feature an area-sound reproduction system according to one aspect of the present disclosure, in order to solve the abovementioned problem, including: a reproducer that includes a speaker array in which a plurality of speakers are linearly arranged side by side; a sound collector that collects an environment sound in an environment where the reproducer is installed; and a processor that adjusts reproduced sounds that the plurality of speakers are caused to output, based on a control line that is set at a position substantially in parallel with the speaker array and apart from the speaker array by a predetermined distance, and includes a reproduction line in which sound waves emitted from the speaker array constructively interfere with each other and a non-reproduction line in which the sound waves destructively interfere with each other, and causes the reproduced sounds to be outputted from the reproducer, in which the processor measures a noise level from the collected environment sound, and adjusts the reproduced sounds, at each frequency, such that a sound pressure of the reproduced sound reaching the reproduction line on the control line exceeds the noise level, and a sound pressure of the reproduced sound reaching the non-reproduction line on the control line does not exceed the noise level.

The abovementioned aspect can implement an area-sound reproduction that allows the reproduced sounds to be appropriately adjusted in accordance with the environment sound.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Figure 1:
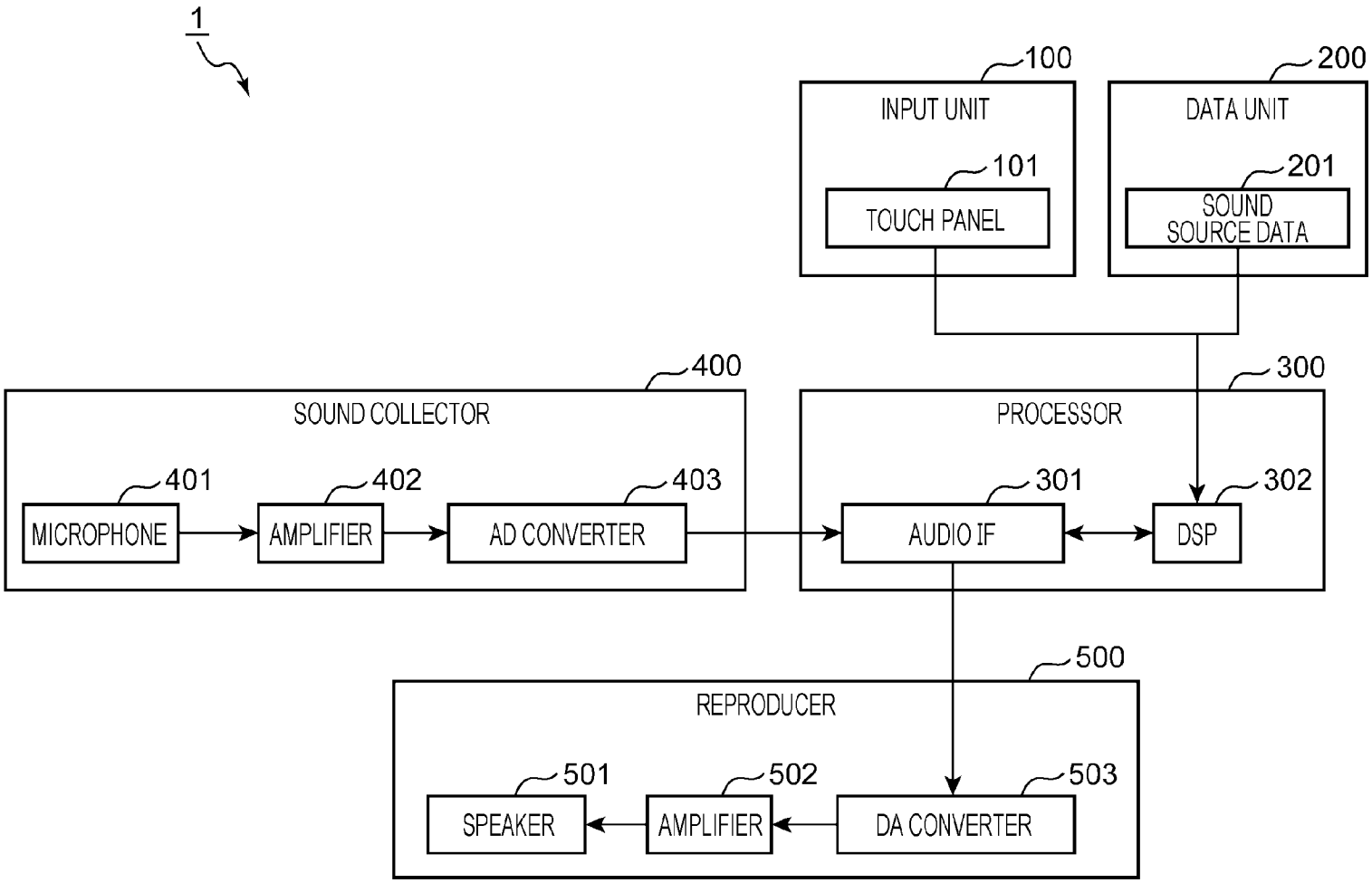
FIG. 1 is a diagram illustrating a configuration of an area-sound reproduction system in embodiments of the present disclosure.

DETAILED DESCRIPTION (Underlying Knowledge Forming Basis of the Present Disclosure)

The principle of the present disclosure will be described. The spherical propagation of a reproduced sound outputted from a typical speaker does not allow the reproduced sound to be delivered to only a specific user. However, controlling the amplitudes and the phases of reproduced sounds outputted from multiple speakers allows the reproduced sounds to be delivered to the specific user without the reproduced sounds from the speakers being diffused. Therefore, conventionally, as a method of implementing an area-sound reproduction, a directionality control has been proposed in which beamforming is performed by controlling the amplitudes and the phases of signals to be inputted into the speakers (Japanese Unexamined Patent Application Publication No. 2010-11269). However, the directionality control has had a problem of a low performance of the area-sound reproduction because the directionality control cannot suppress the diffusion of the sounds in a non-reproduction area to which the reproduced sounds are not intended to be delivered.

Therefore, in recent years, an area-sound reproduction control based on space filtering in which the directionality control is developed is newly proposed. This control can control the reproduced sounds not only in a reproduction area to which the reproduced sounds are intended to be delivered but also in a non-reproduction area to which the reproduced sounds are not intended to be delivered, thereby making it possible to implement an area-sound reproduction performance higher than that of the conventional directionality control.

In the area-sound reproduction control based on the space filtering, an arbitrary control line in parallel with a speaker array is firstly set as a reproduction condition, and on the control line, a reproduction line in which the reproduced sounds constructively interfere with each other and a non-reproduction line in which destructively interfere with each other are set. A control filter for implementing the area-sound reproduction with the set reproduction condition is then derived. The area-sound reproduction is eventually implemented with the set reproduction condition by causing each speaker to output a signal in which the derived control filter is convolved into a signal of the reproduced sound. Note that, the control filter and the reproduction condition are associated with each other by a spatial Fourier transform. This allows a control filter to be uniquely derived from the reproduction condition.

In this manner, the area-sound reproduction control based on the space filtering allows a non-reproduction line to be freely set as a reproduction condition on the control line, thereby allowing control of the reproduced sounds in the non-reproduction area, which is difficult by the directionality control. Moreover, when multiple different reproduced sounds are individually reproduced on the control line, a reproduction condition that a reproduction place of the reproduced sound is a reproduction line is set for each reproduced sound, and a control filter by which an area-sound reproduction is implemented with each reproduction condition is derived. Further, the control filter corresponding to each reproduced sound is convolved into a signal of each reproduced sound, these signals are thereafter added up, and each speaker is caused to output the reproduced sound. This can individually reproduce the multiple different reproduced sounds on the control line (Japanese Unexamined Patent Application Publication No. 2015-231087).

When such an area-sound reproduction technique is actually used, it is important to cause a user to reliably listen to the reproduced sounds emitted from the speaker array, on the reproduction line. However, there has been a problem in that when high noise is generated in the surrounding environment, the reproduced sound is canceled by the noise to disable the user to listen to the reproduced sounds. To solve this problem, it can be considered that the reproduced sounds are reproduced with a higher sound volume so as to prevent the reproduced sounds from being canceled by the noise. However, increase in the sound volume of the reproduced sound causes a problem in which the reproduced sound is leaked to portions other than the reproduction line. Technical solutions to deal with these problems have not been discussed.

In order to solve such problems, an area-sound reproduction system according to one aspect of the present disclosure including: a reproducer that includes a speaker array in which a plurality of speakers are linearly arranged side by side; a sound collector that collects an environment sound in an environment where the reproducer is installed; and a processor that adjusts reproduced sounds that the plurality of speakers are caused to output, based on a control line, and causes the reproducer to output the reproduced sounds, the control line being set at a position substantially in parallel with the speaker array and apart from the speaker array by a predetermined distance, and including a reproduction line in which sound waves emitted from the speaker array constructively interfere with each other and a non-reproduction line in which the sound waves destructively interfere with each other, in which the processor measures a noise level from the collected environment sound, and adjusts the reproduced sounds, at each frequency, such that a sound pressure of the reproduced sound reaching the reproduction line on the control line exceeds the noise level, and a sound pressure of the reproduced sound reaching the non-reproduction line on the control line does not exceed the noise level.

With the present configuration, a noise level is measured from the collected environment sound, and the reproduced sounds are adjusted, at each frequency, such that a sound pressure of the reproduced sound reaching the reproduction line on the control line exceeds the noise level, and a sound pressure of the reproduced sound reaching the non-reproduction line on the control line does not exceed the noise level. This can prevent the reproduced sound reaching the reproduction line from being canceled by the environment sound, and cancel the reproduced sound reaching the non-reproduction line by the environment sound to prevent the leakage of the reproduced sound to portions other than the reproduction line. In this manner, the present configuration can implement an area-sound reproduction that allows the reproduced sounds to be appropriately adjusted in accordance with the environment sound.

Moreover, the adjustment of the reproduced sounds may be an adjustment to remove a frequency component in which the sound pressure of the reproduced sound reaching the non-reproduction line on the control line exceeds the noise level.

The present configuration allows the sound pressure of the reproduced sound reaching the non-reproduction line equal to or less than the noise level, at each frequency. This can cancel the reproduced sound reaching the non-reproduction line with the environment sound, and thus prevent the leakage of the reproduced sound to the non-reproduction line.

Moreover, the processor further receives change in the sound volume of the reproduced sound reaching the reproduction line, and may remove a frequency component in which the sound pressure of the reproduced sound reaching the non-reproduction line on the control line exceeds the noise level, due to the change in the sound volume of the reproduced sound.

The present configuration allows the sound pressure of the reproduced sound reaching the non-reproduction line equal to or less than the noise level, at each frequency, even in a case where the sound volume of the reproduced sound reaching the reproduction line is changed. This can cancel the reproduced sound reaching the non-reproduction line by the environment sound, and thus prevent the leakage of the reproduced sound to the non-reproduction line.

Moreover, at each frequency, when the sound pressure of the reproduced sound reaching the reproduction line on the control line exceeds the noise level, and the sound pressure of the reproduced sound reaching the non-reproduction line on the control line exceeds the noise level, the processor may adjust the width of the reproduction line such that the sound pressure of the reproduced sound reaching the non-reproduction line does not exceed the noise level.

With the present configuration, the width of the reproduction line is adjusted such that the sound pressure of the reproduced sound reaching the non-reproduction line does not exceed the noise level. This can prevent the leakage of the reproduced sound to the non-reproduction line.

Moreover, at each frequency, when the sound pressure of the reproduced sound reaching the reproduction line on the control line exceeds the noise level, and the sound pressure of the reproduced sound reaching the non-reproduction line on the control line exceeds the noise level, the processor may perform an adjustment of synthesizing a masking sound reaching the non-reproduction line into the reproduced sound reaching the non-reproduction line, such that a sound pressure of the masking sound exceeds the sound pressure of the reproduced sound.

The present configuration allows the reproduced sound reaching the non-reproduction line to be masked with the masking sound. This can prevent the leakage of the reproduced sound to the non-reproduction line.

Moreover, the masking sound may be the environment sound collected by the sound collector.

With the present configuration, the environment sound is employed as the masking sound. This can reduce a discomfort feeling that is felt due to a sound different from the environment sound being heard on the non-reproduction line.

Moreover, the masking sound may be a background music used in an environment where the reproducer is installed.

With the present configuration, the background music is employed as the masking sound. This can reduce a discomfort feeling that is felt due to a sound different from the background music being heard on the non-reproduction line.

Moreover, the sound collector may include a microphone that is mounted in a terminal used by a user of the area-sound reproduction system.

The present configuration allows the environment sound at the position of a user to be precisely collected with no microphone being provided in the area-sound reproduction system.

Moreover, the processor further may acquire information related to a position of a person from a sensor that is included in the area-sound reproduction system or externally provided, and set the control line based on the information related to the position of the person.

The present configuration allows the control line to be automatically set based on the information related to the position of the person acquired from the sensor, without causing the user to make an effort of designating the control line.

Moreover, the present disclosure discloses not only the area-sound reproduction system including a processing executing unit that executes the characteristic processing as in the foregoing, but also an area-sound reproduction method that executes the abovementioned characteristic processing in the area-sound reproduction system.

Note that, embodiments described below each indicate one specific example of the present disclosure. Numerical values, shapes, constituent elements, steps, and the order of the steps indicated in the following embodiments are merely examples, and are not intended to limit the present disclosure. Moreover, among constituent elements described in the following embodiments, those constituent elements that are not described in independent claims indicating the highest-level concepts of the present disclosure are described as arbitrary constituent elements. In all the embodiments, the respective contents can be combined.

(Overview of System)

Firstly, an overview of an area-sound reproduction system in the embodiments of the present disclosure will be described.

FIG. 1 is a diagram illustrating a configuration of an area-sound reproduction system 1 in embodiments of the present disclosure. The area-sound reproduction system 1 includes an input unit 100, a data unit 200, a processor 300, a sound collector 400, and a reproducer 500.

The input unit 100 is a terminal device including a touch panel 101 through which various kinds of designation operations of: sound source data 201; a reproduction condition, which is described later; a reproduced sound volume; and the like, of reproduced sounds that speakers 501, which are described later, are caused to reproduce, are performed. Further, the input unit 100 is not limited to the touch panel 101, but may be a physical key board and a physical mouse, or a terminal device provided with a user interface (UI) that allows the abovementioned designation operations to be performed by a gesture.

Moreover, the input unit 100 may be a terminal device, such as a smartphone and a tablet, that is used by a user of the area-sound reproduction system 1, or may be a terminal device, such as a personal computer that is provided inside a room as a target of area-sound reproduction by the area-sound reproduction system 1 and is commonly used by multiple users.

The data unit 200 is a storage device such as a random access memory (RAM) and a hard disk drive (HDD). The data unit 200 stores therein the sound source data 201. The sound source data 201 is outputted to a digital signal processor (DSP) 302 through a network such as the Internet. Further, the data unit 200 may be provided in the same device in which the processor 300 (the DSP 302), which is described later, is provided, or may be provided in a device different from a device in which the processor 300 (the DSP 302) is provided.

The processor 300 is an information processing device including a microprocessor, a ROM, a RAM, a hard disk drive, a key board, a mouse, a display unit, and the like. The processor 300 includes an audio IF 301 into and from which sound data is inputted and outputted, and the DSP 302. Further, the DSP 302 and the audio IF 301 may be provided in different information processing devices, and the DSP 302 may be connected to the audio IF 301 through a network such as the Internet. Moreover, the DSP 302, which is impossible to be connected to the Internet alone, may be connected to the Internet via a home gateway.

The sound collector 400 is a sound input device including a microphone 401 that collects an environment sound in the surrounding, an amplifier 402 that amplifies an analog signal (hereinafter, environment sound signal) indicating the environment sound collected by the microphone 401, an AD converter 403 that converts the environment sound signal amplified by the amplifier 402 into a digital signal, and the like. Further, the microphone 401 is provided in an environment the same as an environment in which the speakers 501, which are described later, are installed, such as a ceiling in a room the same as a room in which the speakers 501 are installed. Moreover, one or multiple microphones 401 may be provided. Moreover, the sound collector 400 may be provided in the same device in which the input unit 100 is provided.

The reproducer 500 is a sound output device including a DA converter 503 that converts sound data, such as the sound source data 201, inputted from the audio IF 301, into an analog signal, an amplifier 502 that amplifies the analog signal (hereinafter, reproduced sound signal) converted by the DA converter 503, the speaker 501 that outputs a reproduced sound indicated by the reproduced sound signal amplified by the amplifier 502, and the like.

Further, the reproducer 500 includes the multiple speakers 501, and constitutes a speaker array SA in which these multiple speakers 501 are linearly arranged at predetermined intervals therebetween. As is described later, the performance of the area-sound reproduction changes depending on an arrangement interval Δx of each of the speakers 501, a total length L of the speaker array SA, and the like. Further, the type and the size of the speakers 501 are not limited.

Figure 2:
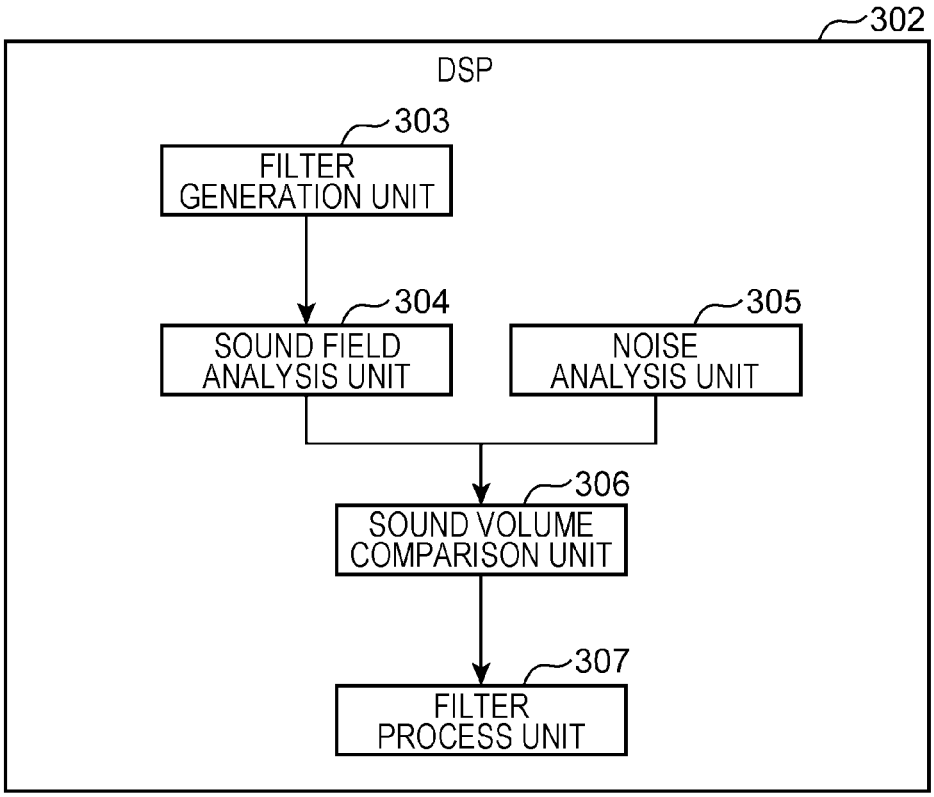
FIG. 2 is a diagram illustrating an internal configuration of a processor in the embodiments of the present disclosure.

Next, the DSP 302 will be described in detail. FIG. 2 is a diagram illustrating an internal configuration of the DSP 302 in the embodiments of the present disclosure. As illustrated in FIG. 2, the DSP 302 includes a filter generation unit 303, a sound field analysis unit 304, a noise analysis unit 305, a sound volume comparison unit 306, and a filter process unit 307.

The filter generation unit 303 generates a control filter for implementing the area-sound reproduction with a reproduction condition designated by a user using the input unit 100.

The sound field analysis unit 304 performs a frequency analysis on a reproduced sound that can be considered to reach a control line CL, when each of the speakers 501 is caused to output a signal in which the control filter generated by the filter generation unit 303 is convolved into a reproduced sound signal (hereinafter, reproduced sound signal corresponding to the sound source data 201) in which the sound source data 201 designated by the user using the input unit 100 is converted into an analog signal.

The noise analysis unit 305 performs a frequency analysis on an environment sound collected by the sound collector 400 to measure the sound pressure (noise level) of the environment sound, for each frequency.

The sound volume comparison unit 306 compares the frequency analyzed result of the reproduced sound by the sound field analysis unit 304 with the measurement result of the sound pressure of the environment sound by the noise analysis unit 305, for each frequency.

The filter process unit 307 processes, in accordance with the comparison result by the sound volume comparison unit 306, the control filter generated by the filter generation unit 303.

Next, a generation method of a control filter by the filter generation unit 303 will be described. Hereinafter, it is assumed that the speakers 501 constituting the speaker array SA are arranged side by side on an x axis. On a plan represented by the x axis and a y axis orthogonal to the x axis, out of reproduced sounds of an angular frequency ω outputted from the speakers 501 at a position A (x0, 0) in the speaker array SA, a sound pressure P(x, $y_{ref}$, ω) of the reproduced sound of the angular frequency ω that reaches a control point B(x, $y_{ref}$) is given the following expression (1).

$$P(x,y_{ref},\omega)=\int_{-\infty}^{\infty}D(x_0,0,\omega)G(x-x_0,y_{ref},\omega)dx_0 \tag{1}$$

In the expression (1), D (x0, 0, ω) indicates a drive signal of each speaker, and G(x−$x_0$, $y_{ref}$, ω) indicates a transmission function from each of the speakers 501 to the control point B(x, $y_{ref}$). Further, the transmission function G(x−$x_0$, $Y_{ref}$, ω) is a green function in a three-dimensional free space. Moreover, when the frequency of a reproduced sound is f, the angular frequency ω of the reproduced sound is expressed as 2πf (ω=2πf).

With a convolution theorem in which the expression (1) is Fourier transformed in the x axis direction, the following expression (2) is obtained.

$$\tilde{P}(k_x,y_{ref},\omega)=\tilde{D}(k_x,\omega)\cdot\tilde{G}(k_x,y_{ref},\omega) \tag{2}$$

Here, "~" indicates a value in a wave number region. kx indicates a spatial frequency in the x axis direction. In addition, when a reproduced sound signal that the speaker 501 is caused to output is S(ω), and the control filter is F(x0, 0, ω), a drive signal D(x0, 0, ω) of the speaker at the position A is expressed by the following expression (3).

$$D(x_0,0,\omega)=S(\omega)F(x_0,0,\omega) \tag{3}$$

The control filter F(x0, 0, ω) does not depend on the reproduced sound, thus, S(ω)=1 is set hereinafter. Accordingly, from the result in which the expression (3) is Fourier transformed in the x axis direction and the expression (2), the following expression (4) is obtained.

$$\tilde{F}(k_x,\omega)=\frac{\tilde{P}(k_x,y_{ref},\omega)}{\tilde{G}(k_x,y_{ref},\omega)} \tag{4}$$

Figure 3:
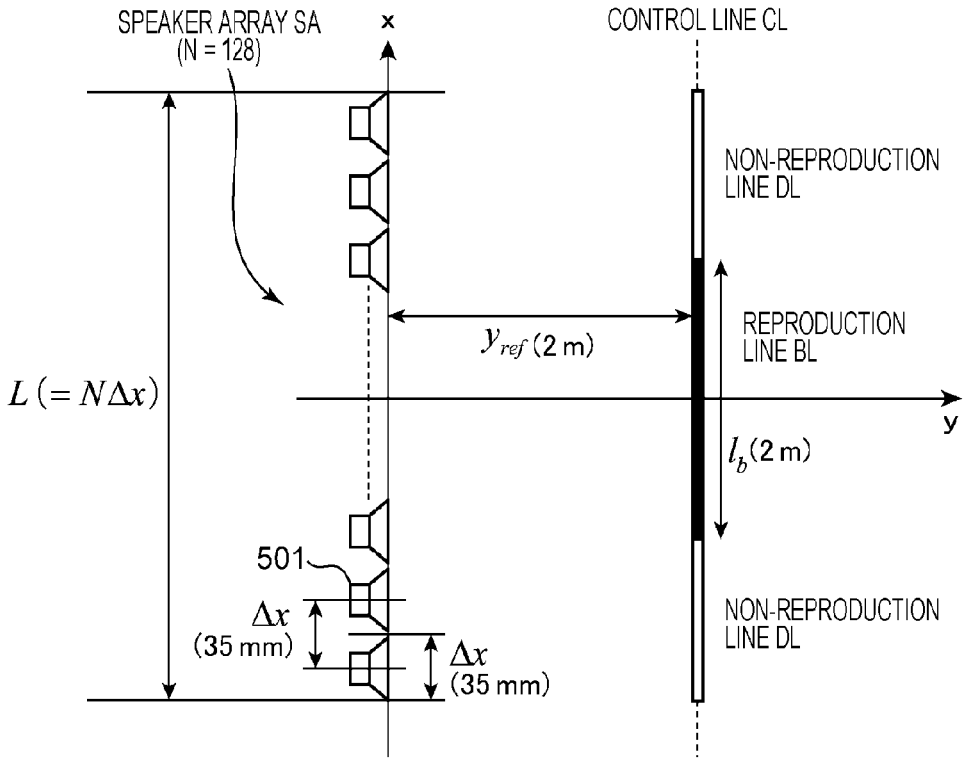
FIG. 3 is a diagram illustrating an example of a reproduction line and non-reproduction lines in the embodiments of the present disclosure.

FIG. 3 is a diagram illustrating an example of a reproduction line BL and a non-reproduction line DL in the embodiments of the present disclosure. For implement of the area-sound reproduction, as illustrated in FIG. 3, on the control line CL that is substantially in parallel with the speaker array SA and set at a position apart from the speaker array SA by a distance $y_{ref}$, the reproduction line BL in which sound waves emitted from the speaker array SA constructively interfere with each other and the non-reproduction line DL in which the sound waves therefrom destructively interfere with each other may be determined. In the embodiments of the present disclosure, the length of the reproduction line BL in the x axis direction (hereinafter, the width of the reproduction line BL) is set as $I_b$. Further, the center of the reproduction line BL in the x axis direction is set as x=0, and the sound pressure P(x, $y_{ref}$, ω) of the reproduced sound reaching the control point B(x, $y_{ref}$) on the control line CL is modeled as a rectangular wave expressed by the following expression (5).

$$P(x,y_{ref},\omega)=\begin{cases}1, & \text{for } |x|\le\frac{l_b}{2}\\ 0, & \text{otherwise}\end{cases} \tag{5}$$

The control filter F(x, 0, ω) for implementing the area-sound reproduction can be analytically derived in such a manner that the sound pressure of the reproduced sound in the wave number region that is obtained by subjecting the expression (5) to a Fourier transform in the x axis direction is substituted into the expression (4), and a control filter in the wave number region that is obtained as a result thereof is subjected to an inverse Fourier transform, as an expression (6).

$$F(x,0,\omega)=F^{-1}\left[\frac{l_b\,\mathrm{sinc}(k_x l_b/2\pi)}{\tilde{G}(k_x,y_{ref},\omega)}\right] \tag{6}$$

Here, $F^{-1}$[ ] on the right side indicates the inverse Fourier transform, and an expression described in [ ] indicates the control filter in the wave number region.

Further, the expression (6) is an expression obtained by assuming that the speakers 501 provided in the speaker array SA are infinitely arranged side by side the x axis. In actual, the number of the speakers 501 provided in the speaker array SA is a finite number, thus, the control filter F(x, 0, ω) needs to be discretized and derived.

Specifically, as illustrated in FIG. 3, the number of the speakers 501 provided in the speaker array SA is set as N, an arrangement interval between the respective speakers 501 is set as Δx, and the length of the speaker array SA in the x axis direction is set as L. In this case, the discretized control filter F(x, 0, ω) can be analytically derived as the following expression (7) in such a manner that the control filter in the wave number region that is expressed by an expression in [ ] on the right side of the expression (6) is subjected to an inverse discrete Fourier transform.

$$F(x, 0, \omega) = \frac{1}{L}\sum_{m=-N/2}^{N/2-1}\left(\frac{l_b \mathrm{sinc}(k_x l_b/2\pi)}{\tilde{G}(k_x, y_{ref}, \omega)}\right)\exp\left(\frac{2\pi jnm}{N}\right) \tag{7}$$

where $x = n\Delta x\ (-N/2 \leqq n \leqq N/2-1)$, $L = N\Delta x,\ k_x = 2\pi m/N\Delta x$ Therefore, the filter generation unit 303 substitutes: 1) the arrangement interval Δx of each of the speakers 501; 2) the number N of the speakers 501 provided in the speaker array SA; 3) the distance $y_{ref}$ in the y axis direction from the speaker array SA to the control line CL; and 4) the width $I_b$ of the reproduction line BL, into the expression (7), to generate the control filter F(x, 0, ω).

(First Embodiment)

Figure 4:
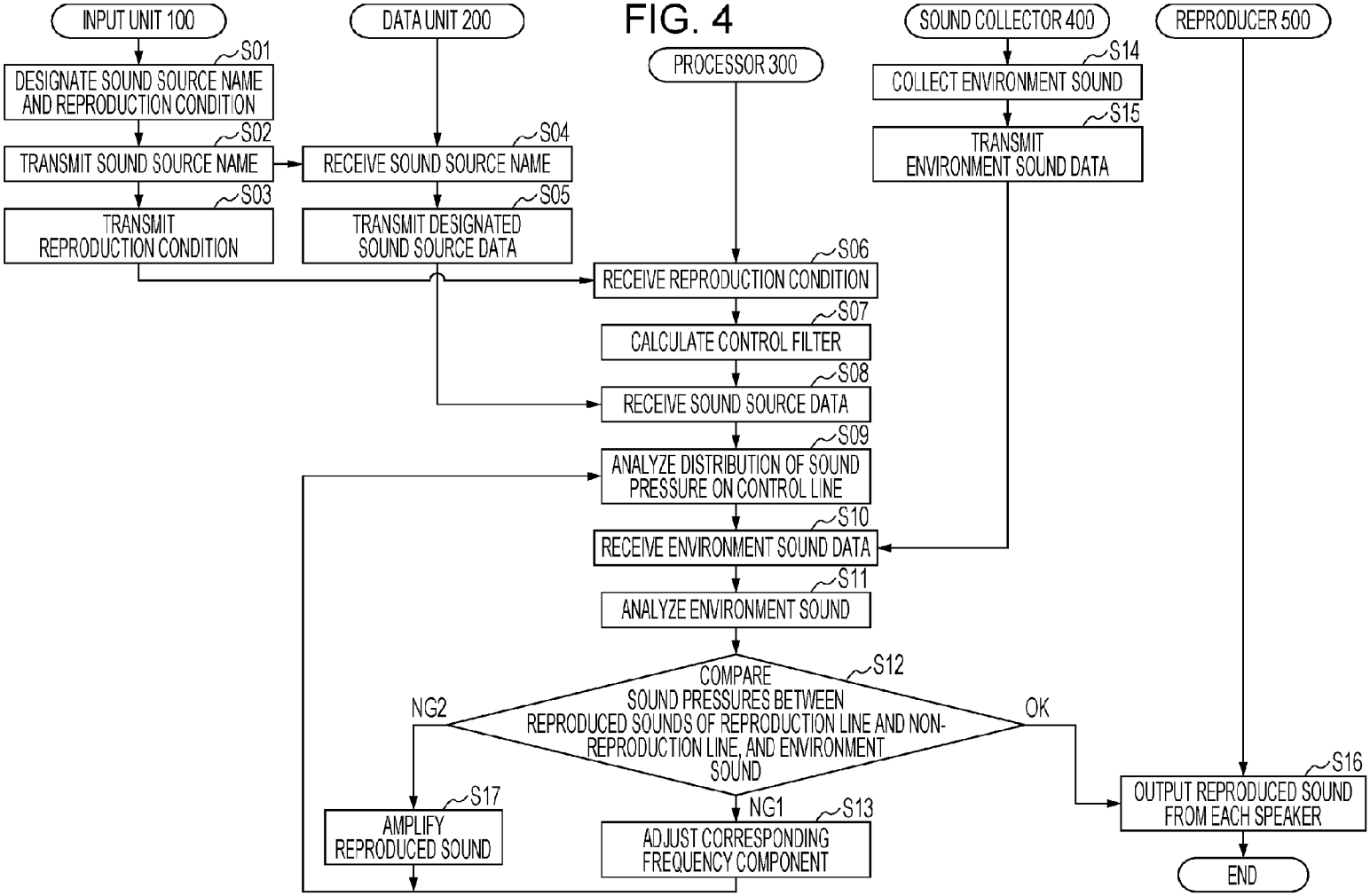
FIG. 4 is a flowchart illustrating an example of an adjustment operation of reproduced sounds in a first embodiment.

Hereinafter, an adjustment operation of reproduced sounds that the speakers 501 are caused to output in a first embodiment will be described. FIG. 4 is a flowchart illustrating an example of the adjustment operation of reproduced sounds in the first embodiment. Firstly, when a user designates a name of the sound source data 201 (hereinafter, sound source name) and a reproduction condition, of a reproduced sound, using the touch panel 101 (S01), the input unit 100 transmits the designated sound source name to the data unit 200 (S02), and transmits the designated reproduction condition to the processor 300 (S03).

The reproduction condition designated at Step S01 includes the abovementioned conditions of: 1) the arrangement interval Δx of each of the speakers 501; 2) the number N of the speakers 501 provided in the speaker array SA; 3) the distance $y_{ref}$ in the y axis direction from the speaker array SA to the control line CL; and 4) the width $I_b$ of the reproduction line BL which are necessary for generating the control filter F(x, 0, ω), and 5) the sound volume of the reproduced sound on the reproduction line BL and the like. Further, a part of or all of the abovementioned conditions 1) to 5) may not be included in the reproduction condition.

Next, upon reception of the sound source name (S04), the data unit 200 transmits the sound source data 201 corresponding to the sound source name to the processor 300 (S05).

When the processor 300 receives the reproduction condition (S06), the filter generation unit 303 performs a calculation to substitute the abovementioned conditions 1) to 4) included in the reproduction condition into the expression (7) to generate the control filter F(x, 0, ω) for implementing the area-sound reproduction with the reproduction condition (S07).

Further, it is assumed that the abovementioned condition 5) (the sound volume of the reproduced sound on the reproduction line BL) is included in the reproduction condition received at Step S06. In this case, the filter generation unit 303 generates r*F(x, 0, ω) that is a result of multiplying the control filter F(x, 0, ω) calculated using the abovementioned conditions 1) to 4) by a rate r (=the sound volume of the reproduced sound/the maximum sound volume) of the sound volume of the reproduced sound indicated by the condition 5) relative to a predetermined maximum sound volume, as the control filter F(x, 0, ω).

Meanwhile, as described above, there is a case where a part of or all of the abovementioned conditions 1) to 4) are not included in the reproduction condition designated at Step S01. When the abovementioned conditions 1) and 2) are not included, the filter generation unit 303 acquires an arrangement interval Δx of each of the speakers 501 and the number N of the speakers 501 provided in the speaker array SA, which are stored in advance in a ROM or the like, and sets these as the abovementioned conditions 1) and 2).

Moreover, when the abovementioned condition 3) is not included, the filter generation unit 303 acquires information related to a position of a person from a predetermined sensor, which is not illustrated, included in the area-sound reproduction system 1 or externally provided. The filter generation unit 303 then sets, based on the acquired information related to a position of a person, the abovementioned condition 3) for setting the control line CL.

Specifically, the abovementioned predetermined sensor includes, for example, a camera and a sensor that acquires a thermal image. The abovementioned predetermined sensor may be incorporated in the same device in which the sound collector 400 or the reproducer 500 are provided, or may be provided in the outside of the area-sound reproduction system 1. The abovementioned predetermined sensor only needs to transmit an output signal to the processor 300.

For example, it is assumed a case where as the abovementioned predetermined sensor, a camera, which is not illustrated, that captures an image toward the y axis direction is provided on the same x axis as the speaker array SA. In this case, the filter generation unit 303 acquires a captured image outputted by the camera, and recognizes whether a person is included in the captured image using a publicly known image recognition technique and the like. If the filter generation unit 303 recognizes that a person is included in the captured image, the filter generation unit 303 calculates, based on a rate between the size of an image indicating the recognized person and the size of the captured image, or the like, a distance in the y axis direction from the x axis to a position of the person.

Alternatively, it is assumed a case where as the abovementioned predetermined sensor, provide is a sensor (for example, depth sensor) that measures a distance in the y axis direction from the x axis to a position of a person, and is capable of outputting a signal indicating the measured distance to the processor 300. In this case, the filter generation unit 303 acquires a distance in the y axis direction from the x axis to the position of the person, which is indicated by the output signal from the sensor.

The filter generation unit 303 then sets the distance in the y axis direction from the x axis to the position of the abovementioned person as the abovementioned condition 3) (the distance $y_{ref}$ in the y axis direction from the speaker array SA to the control line CL).

Moreover, when the abovementioned condition 4) is not included, the filter generation unit 303 acquires a fixed value (for example, 1 m) that is determined in advance as the approximate breadth of a person, for example, and stored in advance in a ROM or the like, and set this fixed value as the abovementioned condition 4) (the width $I_b$ of the reproduction line BL).

In this manner, the filter generation unit 303 can automatically set the conditions 1) to 4) based on the information related to the position of the person acquired from the predetermined sensor, without causing a user to make an effort of designating the conditions 1) to 4) necessary for the setting the control line CL. This allows the filter generation unit 303 to automatically set the control line CL.

Next, the processor 300 receives the sound source data 201 (S08). In this case, the sound field analysis unit 304 performs a frequency analysis on a reproduced sound that can be considered to reach the control line CL, when each of the speakers 501 is caused to output a signal in which the control filter F(x, 0, ω) generated at Step S07 is convolved into the reproduced sound signal corresponding to the sound source data 201 (S09).

Figure 5:
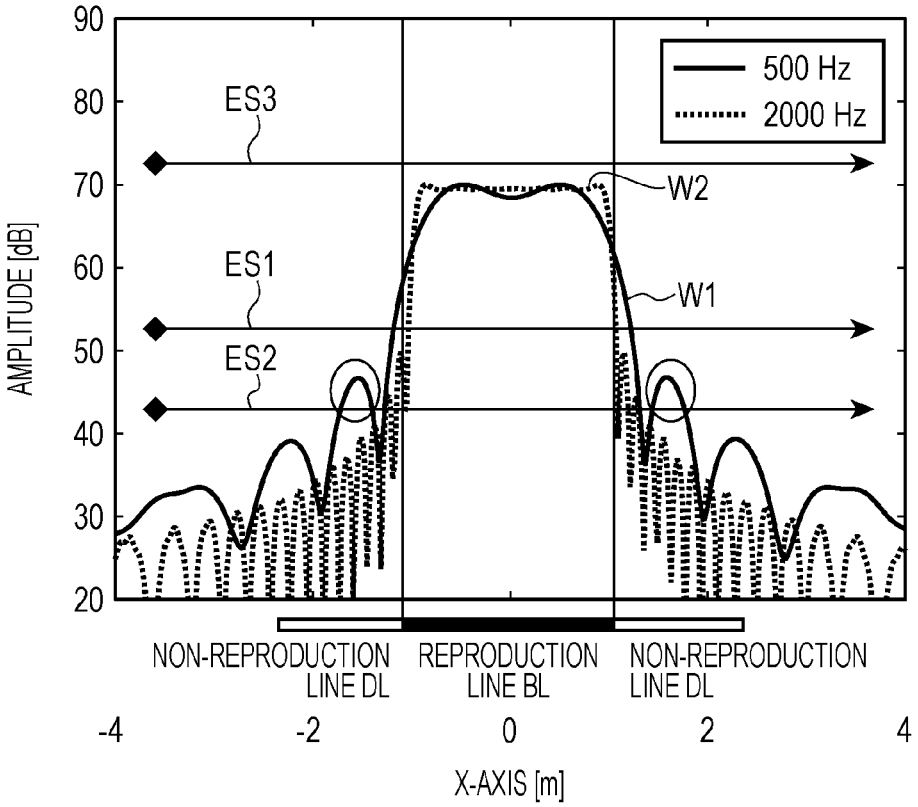
FIG. 5 is a graph illustrating an example of the distribution of sound pressure on a control line in the first embodiment.

Specifically, at Step S09, the sound field analysis unit 304 substitutes a result in which the control filter F(x, 0, ω) generated at Step S07 is subjected to a Fourier transform into the expression (4) and deforms the expression (4). With this, the sound field analysis unit 304 derives an expression indicating the pressure in the wave number region of the reproduced sound reaching the control point B(x, $y_{ref}$) on the control line CL. The sound field analysis unit 304 then subjects the derived expression to an inverse Fourier transform to derive an expression indicating the sound pressure P(x, $y_{ref}$, ω) of the reproduced sound that can be considered to reach the control point B(x, $y_{ref}$) on the control line CL. The sound field analysis unit 304 then generates, as illustrated in FIG. 5 and the like, which are described later, a graph indicating a relation between the control point B(x, $y_{ref}$) on the control line CL and the sound pressure P(x, $y_{ref}$, 2πf) of the reproduced sound, for each frequency f included in the reproduced sound.

The sound collector 400 causes the microphone 401 to collect an environment sound (S14), and the amplifier 402 and the AD converter 403 to convert a signal of the collected environment sound into a digital signal (hereinafter, environment sound data), and thereafter transmits the environment sound data to the processor 300 (S15).

When the processor 300 receives the environment sound data (S10), the noise analysis unit 305 performs a frequency analysis on an environment sound indicated by the environment sound data to measure the sound pressure of the environment sound, for each frequency f (S11). Specifically, at Step S11, the noise analysis unit 305 uses a publicly known frequency analysis technique such as a Fourier transform to calculate, for each frequency f of the environment sound indicated by the environment sound data, a mean value (hereinafter, environment sound pressure mean value) of the sound pressure of the environment sounds corresponding to the respective frequencies f, in the latest predetermined period of time.

Next, the sound volume comparison unit 306 compares the frequency analyzed result of the reproduced sound by the sound field analysis unit 304 at Step S09 with the measurement result of the sound pressure of the environment sound by the noise analysis unit 305 at Step S11, for each frequency f (S12). Specifically, at Step S12, the sound volume comparison unit 306 compares, for each frequency f, a graph (graph indicating (P(x, $y_{ref}$, 2πf)) corresponding to each frequency f generated at Step S09 with the mean value of the environment sound pressure corresponding to each frequency f calculated at Step S11.

As a result of the comparison by the sound volume comparison unit 306, assumed is a case where at all the frequencies f, the sound pressure P(x, $y_{ref}$, 2πf) of the reproduced sound reaching the reproduction line BL exceeds the environment sound pressure mean value, and the sound pressure P(x, $y_{ref}$, 2πf) of the reproduced sound reaching the non-reproduction line DL does not exceed the environment sound pressure mean value (S12; OK). In this case, the processor 300 generates a drive signal D(x, 0, 2πf)(D(x, 0, 2πf)=S(2πf)F(x, 0, 2πf)) in which the control filter F(x, 0, 2πf) generated at Step S07 is convolved into the reproduced sound signal S(2πf) corresponding to the sound source data 201 received at Step S08, and transmits the generated drive signal D(x, 0, 2πf) to the reproducer 500.

The reproducer 500 drives each of the speakers 501 with the received drive signal D(x, 0, 2πf) accordingly to cause each of the speakers 501 to output the reproduced sound (S16).

Meanwhile, as the comparison result by the sound volume comparison unit 306, assumed is a case where at a specific frequency f, both of the sound pressure P(x, $y_{ref}$, 2πf) of the reproduced sound reaching the reproduction line BL and the sound pressure P(x, $y_{ref}$, 2πf) of the reproduced sound reaching the non-reproduction line DL exceed the environment sound pressure mean value (S12; NG1).

In this case, the filter process unit 307 processes the control filter F(x, 0, 2πf) corresponding to the abovementioned specific frequency f generated at Step S07 accordingly to adjust the specific frequency f corresponding to a reproduced sound that each of the speakers 501 is caused to output (S13). Hereinafter, the processing subsequent to Step S09 is repeated using the control filter F(x, 0, 2πf) after being processed at Step S13.

Specifically, at Step S13, the filter process unit 307 sets a product c*F(x, 0, 2πf) of the control filter F(x, 0, 2πf) corresponding to the abovementioned specific frequency f generated at Step S07 and a predetermined damping coefficient c (0≤c<1) equal to or more than 0 and less than 1, as a control filter F(x, 0, 2πf) after being processed corresponding to the abovementioned specific frequency f. In other words, the filter process unit 307 performs an adjustment to attenuate the drive signal D(x, 0, 2πf)(=S(2πf)*F(x, 0, 2πf)) of the reproduced sound corresponding to the specific frequency f to S(2πf)*c*F(x, 0, 2πf).

In particular, when the abovementioned predetermined damping coefficient c is 0, the filter process unit 307 adjusts the drive signal (D(x, 0, 2πf)=S(2πf)F(x, 0, 2πf)) of the reproduced sound corresponding to the specific frequency f to 0 (=S(2πf)*0*F(x, 0, 2πf)). With this, the filter process unit 307 performs an adjustment to remove a frequency component in which the sound pressure of the reproduced sound reaching the non-reproduction line DL exceeds the sound pressure of the environment sound.

Alternatively, as the comparison result by the sound volume comparison unit 306, assumed is a case where at a specific frequency f, both of the sound pressure P(x, $y_{ref}$, 2πf) of the reproduced sound reaching the reproduction line BL and the sound pressure P(x, $y_{ref}$, 2πf) of the reproduced sound reaching the non-reproduction line DL are less than the environment sound pressure mean value (S12; NG2).

In this case, the filter process unit 307 processes the control filter F(x, 0, 2πf) corresponding to the abovementioned specific frequency f generated at Step S07 accordingly to adjust the specific frequency f corresponding to a reproduced sound that each of the speakers 501 is caused to output (S17). Hereinafter, the processing subsequent to Step S09 is repeated using the control filter F(x, 0, 2πf) after being processed at Step S17.

Specifically, at Step S17, the filter process unit 307 sets a product a*F(x, 0, 2πf) of the control filter F(x, 0, 2πf) corresponding to the abovementioned specific frequency f generated at Step S07 and a predetermined amplification coefficient a (1<a) more than 1, as a control filter F(x, 0, 2πf)

after being processed corresponding to the abovementioned specific frequency f. In other words, the filter process unit 307 performs an adjustment to amplify the drive signal D(x, 0, 2πf)(=S(2πf)*F(x, 0, 2πf)) of the reproduced sound corresponding to the specific frequency f to S(2πf)*a*F(x, 0, 2πf).

In this manner, the filter process unit 307 attenuates or removes (S13) or amplifies (S17), at all the frequencies f, the reproduced sound of each frequency f, before the sound pressure P(x, $y_{ref}$, 2πf) of the reproduced sound reaching the reproduction line BL exceeds the environment sound pressure mean value, and the sound pressure P(x, $y_{ref}$, 2πf) of the reproduced sound reaching the non-reproduction line DL does not exceed the environment sound pressure mean value (S12; OK).

Further, assumed is a case where a user present on the reproduction line BL changes the sound volume of the reproduced sound reaching the reproduction line BL, using the touch panel 101. In this case, the processing at Step S03 is executed, and a reproduction condition including the abovementioned condition 5) is transmitted to the processor 300. Hereinafter, the processing subsequent to Step S06 is executed. In other words, at Step S06, the processor 300 receives the reproduction condition including the abovementioned condition 5) transmitted by the input unit 100, thereby receiving the change in the sound volume of the reproduced sound reaching the reproduction line BL.

In this case, as a result that the sound volume of the reproduced sound is increased and the control filter F(x, 0, ω) is increased using the condition 5) included in the reproduction condition at Step S07, there is a case that the sound pressure P(x, $y_{ref}$, 2πf) of the reproduced sound that can be considered to reach the non-reproduction line DL may exceed the environment sound pressure mean value, at Step S12 (S12; NG1). Meanwhile, in this case, the processing at Step S13 is performed, and after an adjustment to attenuate or remove the sound pressure of the frequency component that exceeds the sound pressure of the environment sound, out of the reproduced sounds that can be considered to reach the non-reproduction line DL, is performed, the processing subsequent to Step S09 is repeated.

This allows the sound pressure of the reproduced sound reaching the non-reproduction line DL equal to or less than the sound pressure of the environment sound, at each frequency f, even in a case where the sound volume of the reproduced sound reaching the reproduction line BL is changed. This can cancel the reproduced sound reaching the non-reproduction line DL by the environment sound, and can prevent the leakage of the reproduced sound to the non-reproduction line DL.

The execution order of the respective steps illustrated in FIG. 4 is not limited to the order of executions illustrated in FIG. 4. The order of executions at Steps S06, S08, and S10 in which the processor 300 acquires the reproduction condition, the sound source data 201, and the environment sound data respectively from the input unit 100, the data unit 200, and the sound collector 400, may be switched.

SPECIFIC EXAMPLE 1

Hereinafter, a specific example of the adjustment operation of the reproduced sound illustrated in FIG. 4 will be described. In the present specific example 1, as illustrated in FIG. 3, it is assumed that 128 pieces (N=128) of the speakers 501 each having a width of 35 mm are arranged side by side on the x axis to constitute the speaker array SA. An arrangement interval Δx of each of the speakers 501 is set to 35 mm. Moreover, a line orthogonal to the center of the speaker array SA in the x axis direction is set as a y axis, and the distance from the speaker array SA to the control line CL $y_{ref}$ is set to 2 m. Moreover, the width $I_b$ of the reproduction line BL on the control line CL is set to 2 m, and the center of the reproduction line BL in the x axis direction is on the y axis (x=0).

In other words, at Step S07, assumed is a case where the filter generation unit 303 generates a control filter under such conditions that the abovementioned condition 1) (the arrangement interval Δx of each of the speakers 501) is set to 35 mm, the condition 2) (the number N of the speakers 501 provided in the speaker array SA) is set to 128, the condition 3) (the distance $y_{ref}$ in the y axis direction from the speaker array SA to the control line CL) is set to 2 m, and the condition 4) (the width $I_b$ of the reproduction line BL on the control line CL) is set to 2 m.

Further, the speakers 501 are caused to reproduce reproduced sounds indicated by sine wave signals of the frequencies f of 500 Hz and 2000 Hz. In this case, at Step S09, as illustrated in FIG. 5, the sound field analysis unit 304 generates graphs W1 and W2 indicating the sound pressures P(x, $y_{ref}$, 2πf), which are derived respectively using the control filters F(x, 0, 2πf) corresponding to the two frequencies f and generated at Step S07, of the reproduced sounds reaching the control point (x, $y_{ref}$) on the control line CL and corresponding to the respective frequencies f. Note that, the graph W1 indicates the sound pressure P(x, $y_{ref}$, 1000π) of the reproduced sound corresponding to the frequency f of 500 Hz, and the graph W2 indicates the sound pressure P(x, $y_{ref}$, 4000π) of the reproduced sound corresponding to the frequency f of 2000 Hz.

As indicated in the graphs W1 and W2, a main lobe of the sound pressure of the reproduced sound of each frequency f is formed on the reproduction line BL, and most parts of side lobes thereof are formed on the non-reproduction lines DL. However, the distribution of sound pressure indicated by the side lobes varies depending on the frequency f.

Here, assumed is a case where the environment sound pressure mean values corresponding to the respective frequencies f, calculated at Step S11, are a same sound pressure ES1. In this case, as illustrated in FIG. 5, the sound pressures P(x, $y_{ref}$, 2πf) of the reproduced sounds reaching the reproduction line BL and corresponding to the respective frequencies f, exceed the sound pressure ES1, and the sound pressures P(x, $y_{ref}$, 2πf) of the reproduced sounds reaching the non-reproduction line DL and corresponding to the respective frequencies f, do not exceed the sound pressure ES1 (S12; OK). In this case, the reproduced sounds corresponding to the respective frequencies f are easier to be listened on the reproduction line BL, whereas the environment sounds corresponding to the respective frequencies f are easier to be listened on the non-reproduction lines DL, so that it can be considered that a suitable area-sound reproduction is implemented. In this case, the processing at Step S16 is executed.

Meanwhile, assumed is a case where the environment sound pressure mean values corresponding to the respective frequencies f, calculated at Step S11, are a same sound pressure ES2. In this case, as illustrated in FIG. 5, the sound pressures P(x, $y_{ref}$, 2πf) of the reproduced sounds reaching the reproduction line BL and corresponding to the respective frequencies f exceed the sound pressure ES2. However, as illustrated in elliptic portions of FIG. 5, in the graph W1, the sound pressures P(x, $y_{ref}$, 1000π) of the reproduced sounds reaching parts of the non-reproduction lines DL adjacent to the reproduction line BL also exceed the sound pressure ES2

(S12; NG1). In this case, on the non-reproduction lines DL corresponding to the elliptic portions in FIG. 5, the reproduced sound corresponding to the frequency 500 Hz is easier to be listened than the environment sound, so that it can be considered that a suitable area-sound reproduction is not implemented. In this case, after the processing at Step S13 is executed, the processing subsequent to Step S09 is repeated. Note that, at Step S13, the filter process unit 307 sets a product c*F(x, 0, 1000π) of the control filter F(x, 0, 1000π) corresponding to the frequency 500 Hz and the predetermined damping coefficient c ($0 \leq c < 1$), as a control filter F(x, 0, 1000π) after being processed.

Meanwhile, assumed is a case where the environment sound pressure mean values corresponding to the respective frequencies f, calculated at Step S11, are a same sound pressure ES3. In this case, as illustrated in FIG. 5, none of the sound pressures $P(x, y_{ref}, 2\pi f)$ of the reproduced sounds reaching the reproduction line BL and the non-reproduction lines DL and corresponding to the respective frequencies f exceeds the sound pressure ES3 (S12; NG2). In this case, on the reproduction line BL, the environment sounds corresponding to the respective frequencies f are easier to be listened than the reproduced sounds, so that it can be considered that a suitable area-sound reproduction is not implemented. In this case, after the processing at Step S17 is executed, the processing subsequent to Step S09 is repeated. Note that, at Step S17, the filter process unit 307 sets a product of a*F(x, 0, 2πf) of the control filter F(x, 0, 2πf) corresponding to each frequency f and a predetermined amplification coefficient a ($1 < a$), as a control filter F(x, 0, 2πf) after being processed.

With the present aspect, the processor 300 adjusts, at each frequency f, a reproduced sound such that the sound pressure of the reproduced sound reaching the reproduction line BL on the control line CL exceeds the sound pressure of the environment sound, and the sound pressure of the reproduced sound reaching the non-reproduction line DL on the control line CL does not exceed the sound pressure of the environment sound. This can prevent the reproduced sound reaching the reproduction line BL from being canceled by the environment sound, and cancel the reproduced sound reaching the non-reproduction line DL with environment sound to prevent the leakage of the reproduced sound to portions other than the reproduction line BL. In this manner, the present aspect can implement an area-sound reproduction that allows the reproduced sounds to be appropriately adjusted in accordance with the environment sound.

Moreover, assumed is a case where the abovementioned predetermined damping coefficient c is set to 0, and the filter process unit 307 performs an adjustment to remove a frequency component in which the sound pressure of the reproduced sound reaching the non-reproduction line DL exceeds the sound pressure of the environment sound, at Step S13. In this case, the sound pressure of the reproduced sound reaching the non-reproduction line DL equal to or less than the sound pressure of the environment sound can be made, at each frequency f. This can cancel the reproduced sound reaching the non-reproduction line DL by the environment sound, and thus prevent the leakage of the reproduced sound to the non-reproduction line DL.

Moreover, when the sound collector 400 is provided in the same device in which the input unit 100 is provided, the environment sound at the position of a user can be precisely collected with no microphone being provided in the area-sound reproduction system 1.

(Second Embodiment)

Figure 6:
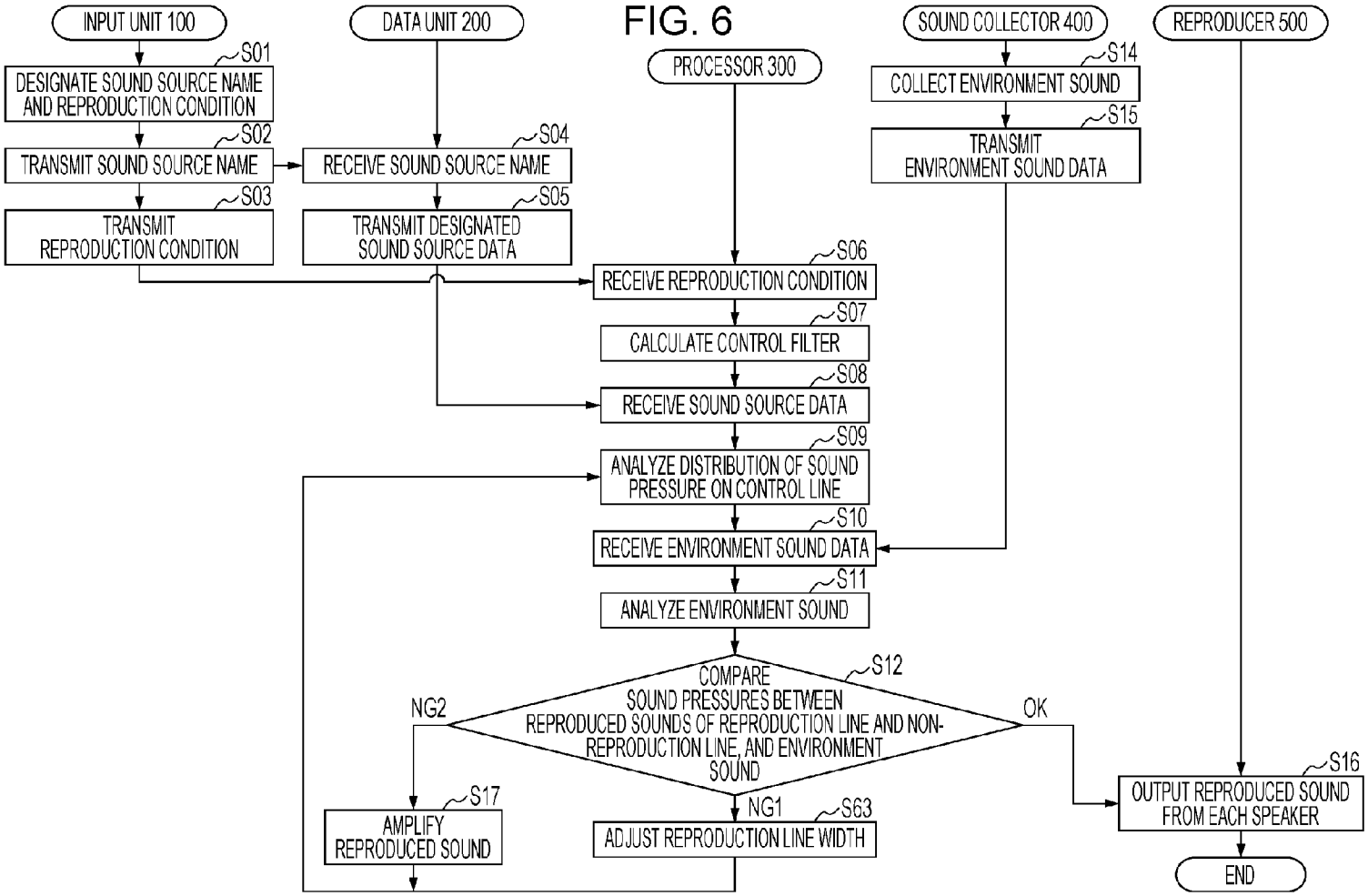
FIG. 6 is a flowchart illustrating an example of an adjustment operation of reproduced sounds in a second embodiment.

The area-sound reproduction system 1 in a second embodiment has a system configuration similar to that of FIG. 1. Therefore, a detailed explanation for an overview of the area-sound reproduction system 1 in the second embodiment is omitted. FIG. 6 is a flowchart illustrating an example of an adjustment operation of reproduced sounds in the second embodiment. As illustrated in FIG. 6, the adjustment operation of the reproduced sound in the second embodiment is different from the adjustment operation of the reproduced sound illustrated in FIG. 4 in the first embodiment in that processing at Step S63, instead of Step S13, is performed. Therefore, a step related to Step S63 is only explained, and detailed explanations related to other steps are omitted.

At Step S12, assumed is a case where at a specific frequency f, both of the sound pressure $P(x, y_{ref}, 2\pi f)$ of the reproduced sound reaching the reproduction line BL and the sound pressure $P(x, y_{ref}, 2\pi f)$ of the reproduced sound reaching the non-reproduction line DL exceed the environment sound pressure mean value (S12; NG1). In this case, the filter process unit 307 adjusts the width of $I_b$ of the reproduction line BL, that is the abovementioned condition 4) used at Step S07 to re-generate the control filter F(x, 0, 2πf) (S63). Thereafter, the processing subsequent to Step S09 is repeated using the control filter F(x, 0, 2πf) after being re-generated at Step S63.

Specifically, at Step S63, the filter process unit 307 reduces, by a predetermined amount, the width of $I_b$ of the reproduction line BL that is the abovementioned condition 4) used at Step S07. Further, the filter process unit 307 performs a calculation to substitute the abovementioned conditions 1) to 3) used at Step S07 and the width $I_b$ after being reduced of the reproduction line BL into the expression (7), similar to Step S07, accordingly to re-generate the control filter F(x, 0, ω).

SPECIFIC EXAMPLE 2

Hereinafter, a specific example of the adjustment operation of the reproduced sound illustrated in FIG. 6 will be described. In the present specific example 2, similar to the abovementioned specific example 1, at Step S07, as illustrated in FIG. 3, assumed is a case where the filter generation unit 303 generates a control filter under such conditions that the abovementioned condition 1) (the arrangement interval Δx of each of the speakers 501) is set to 35 mm, the condition 2) (the number N of the speakers 501 provided in the speaker array SA) is set to 128, and the condition 3) (the distance $y_{ref}$ in the y axis direction from the speaker array SA to the control line CL) is set to 2 m, however, the condition 4) (the width $I_b$ of the reproduction line BL on the control line CL) is set to 3 m. Moreover, the speakers 501 are caused to reproduce reproduced sounds indicated by sine wave signals of the frequency f of 2000 Hz.

Figure 7:
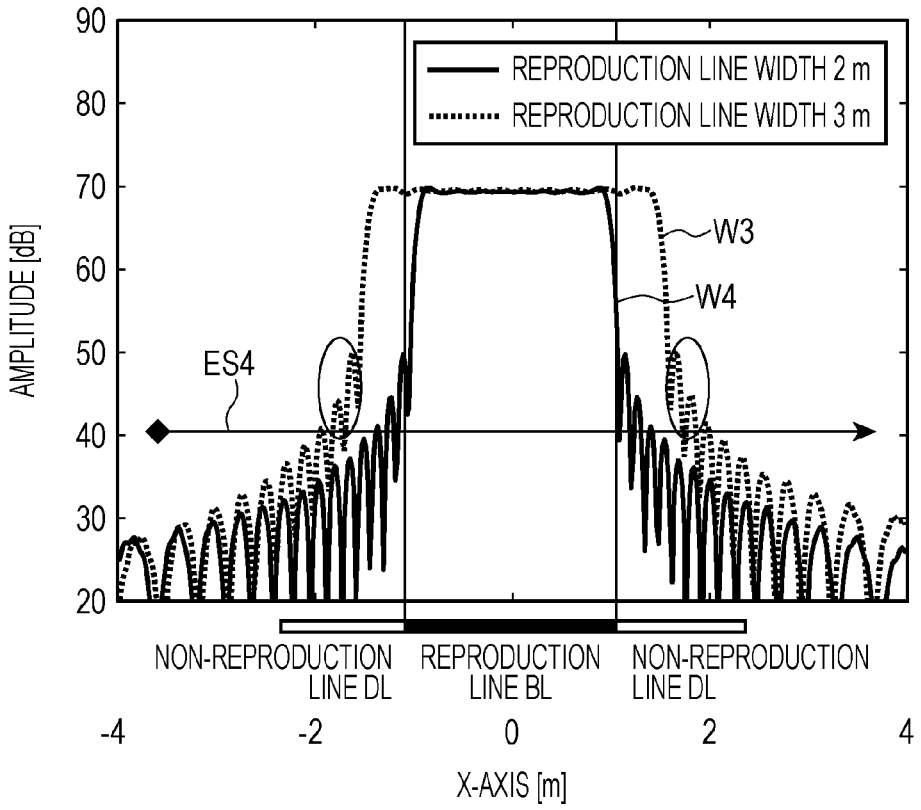
FIG. 7 is a graph illustrating an example of the distribution of sound pressure on the control line in the second embodiment.

In this case, at Step S09, as illustrated in FIG. 7, the sound field analysis unit 304 generates a graph W3 indicating the sound pressure $P(x, y_{ref}, 4000\pi)$, which is derived using the control filter F(x, 0, 4000π) corresponding to the frequency 2000 Hz and generated at Step S07, of the reproduced sound reaching the control point $(x, y_{ref})$ on the control line CL and corresponding to the frequency 2000 Hz.

Here, assumed is a case where the environment sound pressure mean value corresponding to the frequency 2000 Hz, calculated at Step S11, is a sound pressure ES4. In this case, in the graph W3, the sound pressure $P(x, y_{ref}, 4000\pi)$ of the reproduced sound reaching the reproduction line BL and corresponding to the frequency 2000 Hz exceeds the sound pressure ES4. However, as illustrated in elliptic portions of FIG. 7, in the graph W3, the sound pressures P(x, $y_{ref}$, 4000π) of the reproduced sounds reaching parts of the non-reproduction lines DL adjacent to the reproduction line BL and corresponding to the frequency 2000 Hz also exceed the sound pressure ES4 (S12; NG1). In this case, on the non-reproduction lines DL corresponding to the elliptic portions in FIG. 7, the reproduced sound is easier to be listened than the environment sound, so that it can be considered that a suitable area-sound reproduction is not implemented. In this case, after the processing at Step S63 is executed, the processing subsequent to Step S09 is repeated.

At Step S63, the filter process unit 307 reduces, by a predetermined amount, the width of $I_b$ of the reproduction line BL, that is the condition 4) used at Step S07. Here, it is assumed that the predetermined amount is 1 m. In other words, in the present specific example 2, at Step S63, the filter process unit 307 changes the width $I_b$ of the reproduction line BL from 3 m to 2 m. Further, the filter process unit 307 performs a calculation to substitute the abovementioned conditions 1) to 3) used at Step S07 and the width $I_b$ (=2 m) after being reduced of the reproduction line BL into the expression (7), similar to Step S07, accordingly to re-generate the control filter F(x, 0, 4000π).

Note that, the amount by which the width $I_b$ of the reproduction line BL is reduced at Step S63 is not limited to 1 m. Moreover, at Step S63, the filter process unit 307 may reduce the width $I_b$ of the reproduction line BL by multiplying the width $I_b$ of the reproduction line BL by a positive constant less than 1.

At Step S09 that is performed after the Step S63, as illustrated in FIG. 7, the sound field analysis unit 304 generates a graph W4 indicating the sound pressure P(x, $y_{ref}$, 4000π), which is derived using the control filter F(x, 0, 4000π) re-generated at Step S63, of the reproduced sound corresponding to the frequency 2000 Hz.

In the graph W4, the sound pressure P(x, $y_{ref}$, 4000π) of the reproduced sound reaching the reproduction line BL and corresponding to the frequency 2000 Hz exceeds the sound pressure ES4, whereas the sound pressure P(x, $y_{ref}$, 4000π) of the reproduced sounds of the frequency 2000 Hz reaching the non-reproduction lines DL does not exceed the sound pressure ES4 (S12; OK). Therefore, the processing at Step S16 is executed.

With the present aspect, the width of the reproduction line BL is adjusted such that the sound pressure of the reproduced sound reaching the non-reproduction line DL does not exceed the sound pressure of the environment sound. This can prevent the leakage of the reproduced sound to the non-reproduction line DL.

(Third Embodiment)

Figure 8:
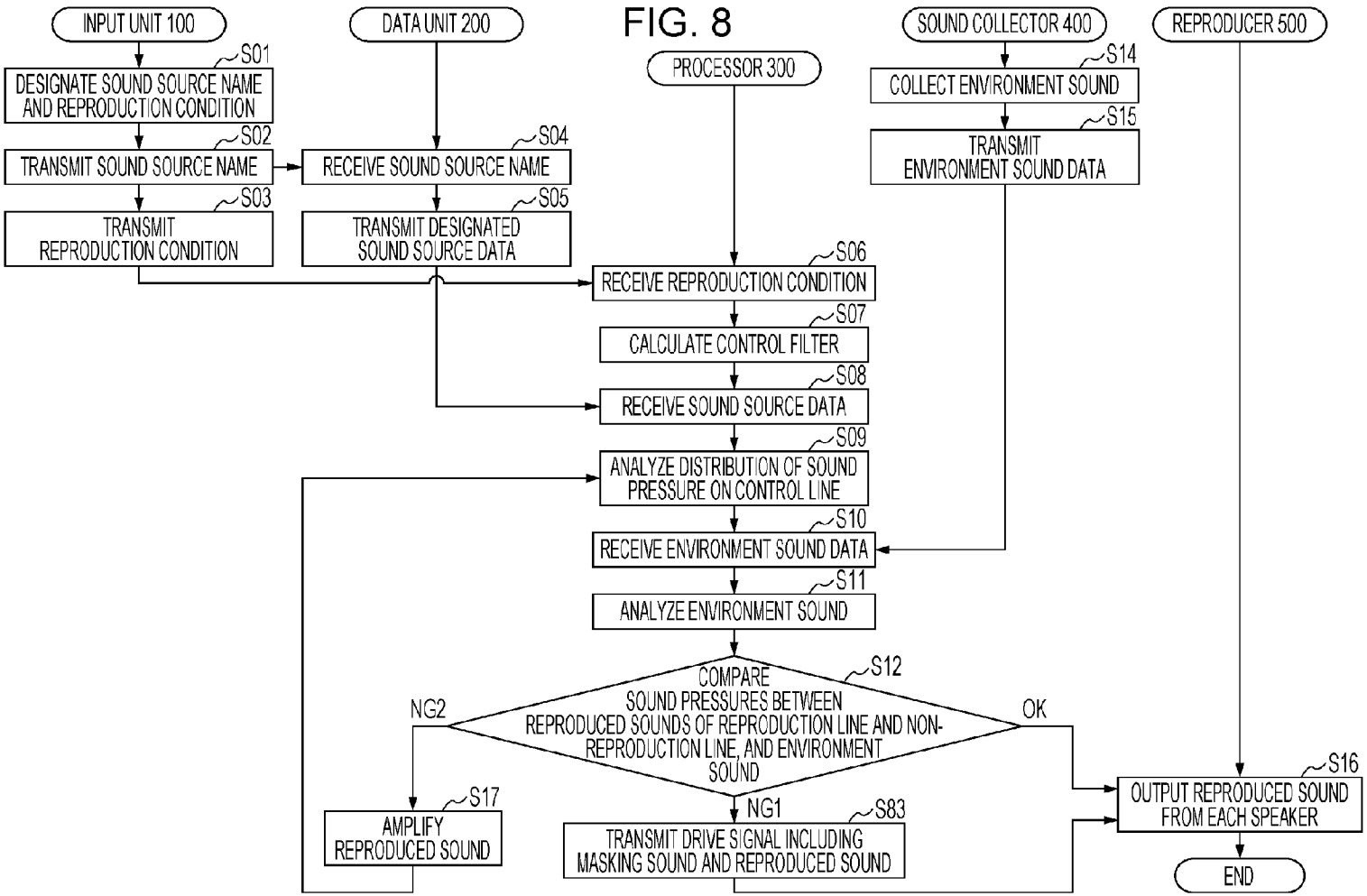
FIG. 8 is a flowchart illustrating an example of an adjustment operation of reproduced sounds in a third embodiment.

The area-sound reproduction system 1 in a third embodiment has a system configuration similar to that of FIG. 1. Therefore, a detailed explanation for an overview of the area-sound reproduction system 1 in the third embodiment is omitted. FIG. 8 is a flowchart illustrating an example of an adjustment operation of reproduced sounds in the third embodiment. As illustrated in FIG. 8, the adjustment operation of the reproduced sound in the third embodiment is different from the adjustment operation of the reproduced sound illustrated in FIG. 4 in the first embodiment in that processing at Step S83, instead of Step S13, is performed, and the processing at Step S16 is performed after the processing at Step S83 has been performed. Therefore, a step related to Step S83 is only explained, and detailed explanations related to other steps are omitted.

At Step S12, assumed is a case where at a specific frequency f, both of the sound pressure P(x, $y_{ref}$, 2πf) of the reproduced sound reaching the reproduction line BL and the sound pressure P(x, $y_{ref}$, 2πf) of the reproduced sound reaching the non-reproduction line DL exceed the environment sound pressure mean value (S12; NG1).

In this case, the processor 300 performs an adjustment of synthesizing a masking sound reaching the non-reproduction line DL into a reproduced sound reaching the non-reproduction line DL such that the sound pressure of the masking sound exceeds the sound pressure P(x, $y_{ref}$, 2πf) of the reproduced sound, and transmits a drive signal for causing each of the speakers 501 to output the reproduced sound, to the reproducer 500 (S83). As a result, the reproducer 500 drives each of the speakers 501 with the received drive signal accordingly to cause each of the speakers 501 to output the masking sound and the reproduced sound (S16).

Specifically, at Step S83, the processor 300 changes the environment sound data received at Step S10 to a digital signal indicating a masking sound. In other words, the processor 300 uses the environment sound collected by the sound collector 400 as a masking sound. Hereinafter, a digital signal indicating a masking sound is described as masking data.

Further, the processor 300 causes the filter generation unit 303 to generate a control filter for implementing the area-sound reproduction in which each of the speakers 501 is caused to output the masking sound using one non-reproduction line DL, out of the abovementioned two non-reproduction lines DL, as the reproduction line BL, by a method similar to that at Step S07. Hereinafter, the generated control filter is described as a control filter F1(x, 0, 2πf).

Further, the processor 300 acquires, from the graph generated at Step S09, a maximum value (hereinafter, reproduced sound maximum value) of the sound pressure P(x, $y_{ref}$, 2πf) of a reproduced sound reaching the one non-reproduction line DL corresponding to the abovementioned specific frequency f. Further, the processor 300 calculates a rate R (=reproduced sound maximum value/environment sound pressure mean value) of the acquired reproduced sound maximum value relative to the environment sound pressure mean value of the abovementioned specific frequency f calculated at Step S11. Further, the processor 300 processes the control filter F1(x, 0, 2πf). Specifically, the processor 300 sets a product R*F1(x, 0, 2πf)*g of the abovementioned calculated rate R, the control filter F1(x, 0, 2πf), and a predetermined amplification coefficient g (1<g) more than 1, as a control filter F1(x, 0, 2πf) after being processed. This allows the processor 300 to cause, when each of the speakers 501 is caused to output the masking sound using the control filter F1(x, 0, 2πf) after being processed, the sound pressure of the masking sound reaching the one non-reproduction line DL and corresponding to the abovementioned specific frequency f to exceed the abovementioned reproduced sound maximum value.

Further, the processor 300 generates a drive signal D1(x, 0, 2πf)(=S(2πf)*F1(x, 0, 2πf)) in which the abovementioned control filter F1(x, 0, 2πf) after being processed is convolved into an analog signal S(2πf) corresponding to the abovementioned masking data.

Similarly, the processor 300 causes the filter generation unit 303 to generate a control filter for implementing the area-sound reproduction in which each of the speakers 501 is caused to output the masking sound using the other non-reproduction line DL, out of the abovementioned two non-reproduction lines DL, as the reproduction line BL. Hereinafter, the generated control filter is described as a control filter F2(x, 0, 2πf). Further, the processor 300 processes the control filter F2(x, 0, 2πf) by the method similar to that of the control filter F1(x, 0, 2πf), and generates a drive signal D2(x, 0, 2πf)(=S(2πf)*F2(x, 0, 2πf)) in which the abovementioned control filter F2(x, 0, 2πf) after being processed is convolved into an analog signal S(2πf) corresponding to the abovementioned masking data.

Moreover, the processor 300 generates a drive signal D(x, 0, 2πf)(=S(2πf)*F(x, 0, 2πf)) in which the control filter F(x, 0, 2πf) generated at Step S07 is convolved into a reproduced sound signal S(2πf) corresponding to the sound source data 201 received at Step S08.

Further, the processor 300 transmits a drive signal in which these generated three drive signals D1(x, 0, 2πf), D2(x, 0, 2πf), and D(x, 0, 2πf) are added up, to the reproducer 500.

SPECIFIC EXAMPLE 3

Hereinafter, a specific example of the adjustment operation of the reproduced sound illustrated in FIG. 8 will be described. In the present specific example 3, similar to the abovementioned specific example 2, at Step S07, as illustrated in FIG. 3, assumed is a case where the filter generation unit 303 generates a control filter under such conditions that the abovementioned condition 1) (the arrangement interval Δx of each of the speakers 501) is set to 35 mm, the condition 2) (the number N of the speakers 501 provided in the speaker array SA) is set to 128, and the condition 3) (the distance $y_{ref}$ in the y axis direction from the speaker array SA to the control line CL) is set to 2 m, however, the condition 4) (the width $I_b$ of the reproduction line BL on the control line CL) is set to 3 m. Moreover, the speakers 501 are caused to reproduce reproduced sounds indicated by sine wave signals of the frequency f of 2000 Hz.

Figure 9:
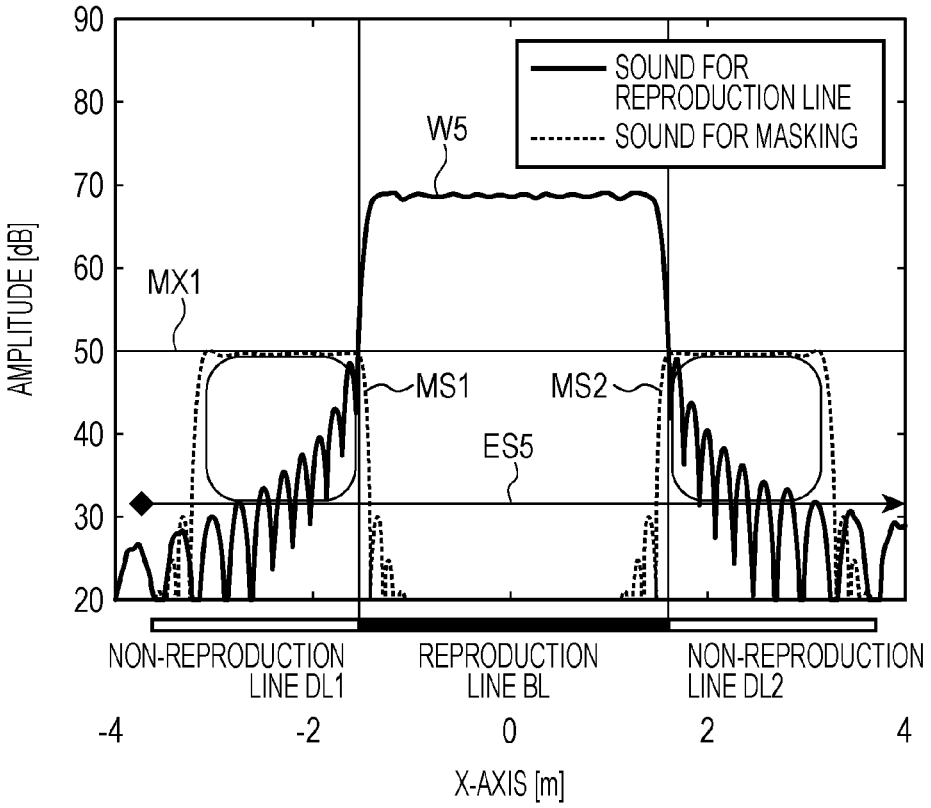
FIG. 9 is a graph illustrating an example of the distribution of sound pressure on the control line in the third embodiment.

In this case, at Step S09, as illustrated in FIG. 9, the sound field analysis unit 304 generates a graph W5 indicating the sound pressure P(x, $y_{ref}$, 4000π), which is derived using the control filter F(x, 0, 4000π) corresponding to the frequency 2000 Hz and generated at Step S07, of the reproduced sound reaching the control point (x, $y_{ref}$) on the control line CL and having the frequency f of 2000 Hz. Here, a reproduced sound maximum value of both of the reproduced sounds reaching two non-reproduction lines DL1 and DL2 adjacent to the reproduction line BL and corresponding to the frequency 2000 Hz is a sound pressure MX1. Hereinafter, the reproduced sound maximum value is described as a reproduced sound maximum value MX1.

Here, assumed is a case where the environment sound pressure mean value corresponding to the frequency 2000 Hz, calculated at Step S11, is a sound pressure ES5. In this case, in the graph W5, the sound pressure P(x, $y_{ref}$, 4000π) of the reproduced sound reaching the reproduction line BL and corresponding to the frequency 2000 Hz exceeds the sound pressure ES5. However, as illustrated in elliptic portions of FIG. 9, in the graph W5, the sound pressures P(x, $y_{ref}$, 4000π) of the reproduced sounds reaching parts of the non-reproduction lines DL1 and DL2 adjacent to the reproduction line BL and having the frequency 2000 Hz also exceed the sound pressure ES5 (S12; NG1). In this case, on the non-reproduction lines DL1 and DL2 corresponding to the elliptic portions in FIG. 9, the reproduced sound is easier to be listened than the environment sound, so that it can be considered that a suitable area-sound reproduction is not implemented. In this case, after the processing at Step S83 is executed, the processing at Step S16 is executed.

At Step S83 the processor 300 acquires the environment sound data received at Step S10 as masking data. Further, the processor 300 generates a control filter F1(x, 0, 4000π) for implementing the area-sound reproduction in which each of the speakers 501 is caused to output a masking sound indicated by the masking data using the non-reproduction line DL1 illustrated in FIG. 9 as the reproduction line BL.

Further, the processor 300 sets a product R*F1(x, 0, 4000π)*g of the rate R(=MX1/ES5) of the reproduced sound maximum value MX1 relative to the environment sound pressure mean value ES5 corresponding to the frequency 2000 Hz, the control filter F1(x, 0, 4000π), and the predetermined amplification coefficient g (1<g) more than 1, as a control filter F1(x, 0, 4000π) after being processed. Further, the processor 300 generates a drive signal D1(x, 0, 4000π) (=S(4000π)*F1(x, 0, 4000π) in which the abovementioned control filter F1(x, 0, 4000π) after being processed is convolved into an analog signal S(4000π) corresponding to the abovementioned masking data.

Similarly, the processor 300 generates and processes a control filter F2(x, 0, 4000π) for implementing the area-sound reproduction in which each of the speakers 501 is caused to output a masking sound indicated by the masking data using the non-reproduction line DL2 illustrated in FIG. 9 as the reproduction line BL. Further, the processor 300 generates a drive signal D2(x, 0, 4000π) (=S(4000π)*F2(x, 0, 4000π) in which the control filter F2(x, 0, 4000π) after being processed is convolved into an analog signal S(4000π) corresponding to the abovementioned masking data.

Moreover, the processor 300 generates a drive signal D(x, 0, 4000π) (=S(4000π)*F(x, 0, 4000π) in which the control filter F(x, 0, 4000π) generated at Step S07 is convolved into the reproduced sound signal S(4000π).

Further, the processor 300 transmits a drive signal in which these generated three drive signals D1(x, 0, 4000π), D2(x, 0, 4000π), and D(x, 0, 4000π) are added up, to the reproducer 500. With this, the reproducer 500 drives each of the speakers 501 with the received drive signal accordingly to cause each of the speakers 501 to output the masking sound and the reproduced sound at Step S16.

When the Step S16 is executed, as illustrated in FIG. 9, each of the speakers 501 outputs a masking sound of the sound pressure distribution illustrated in a graph MS1 with the drive signal D1(x, 0, 4000π), outputs a masking sound of the sound pressure distribution illustrated in a graph MS2 with the drive signal D2(x, 0, 4000π), and a masking sound of the sound pressure distribution illustrated in a graph W5 with the drive signal D(x, 0, 4000π), the drive signals D1, D2, and D being included in the drive signal received at Step S16.

With the present aspect, the reproduced sound reaching the non-reproduction line DL can be masked with the masking sound. This can prevent the leakage of the reproduced sound to the non-reproduction line DL. Moreover, the environment sound collected by the sound collector 400 is employed as the masking sound. This can reduce a discomfort feeling that is felt due to a sound different from the environment sound being heard on the non-reproduction line DL.

Further, the sound source data 201 indicating background music (BGM) used in the environment where the reproducer 500 is installed may be stored in advance in the data unit 200. Together with this, at Step S83, the processor 300 may transmit, in the manner similar to Step S02, S04, and S05, a name of the sound source data 201 indicating the background music to the data unit 200, accordingly to acquire the sound source data 201 from the data unit 200. Further, the processor 300 may use the acquired sound source data 201 as masking data. In other words, the background music used in the environment where the reproducer 500 is installed may be used as a masking sound.

In this case, the background music used in the environment where the reproducer 500 is installed is employed as a masking sound. This can reduce a discomfort feeling that is felt due to a sound different from the background music being heard on the non-reproduction line DL.

In the foregoing, the embodiments of the present disclosure have been explained, and the subjects and the units in which the respective processes are executed are not limited to those described in the abovementioned embodiments. Each process may be processed by a processor or the like that is incorporated into a specific device (hereinafter, local device) with which the area-sound reproduction system 1 is provided. Moreover, each process may be processed by a cloud server or the like that is provided in a different place from the local device. Moreover, the respective processes explained in the present disclosure may be shared and executed by the local device and the cloud server, which establish an information coordination therebetween. Hereinafter, embodiment forms of the present will be described.

(1) The respective devices are specifically a computer system that includes a microprocessor, a ROM, a RAM, a hard disk unit, a display unit, a key board, a mouse, and the like. A computer program is stored in the RAM or the hard disk unit. The microprocessor operates in accordance with the computer program to allow the respective devices to attain functions thereof. The computer program herein is configured by a plurality of instruction codes each indicating a command to the computer being combined, for attaining a predetermined function.

(2) A part or all of components constituting each of the abovementioned devices may be configured by a single system large scale integration (LSI). The system LSI is an ultra-multifunction LSI manufactured by integrating multiple constituent units on a single chip. Specifically, the system LSI is a computer system including a microprocessor, a ROM, a RAM, and the like. A computer program is stored in the RAM. The microprocessor operates in accordance with the computer program to allow system LSI to attain a function thereof.

(3) A part or all of components constituting each of the abovementioned devices may be configured by an IC card or a single module that is detachable/attachable from/to the each device. The IC card or the module is a computer system including a microprocessor, a ROM, a RAM, and the like. The IC card or the module may include the abovementioned ultra-multifunction LSI. The microprocessor operates in accordance with the computer program to allow the IC card or the module to attain a function thereof.

(4) The present disclosure may be a processing method in the area-sound reproduction system 1 indicated above. Moreover, the processing method may be a computer program implemented by a computer, or a digital signal including the computer program.

(5) Moreover, the present disclosure may be a computer-readable recording medium, for example, a flexible disk, a hard disk, a CD-ROM, an MO, a DVD, a DVD-ROM, a DVD-RAM, a Blu-ray (registered trademark) disc (BD), and a semiconductor memory, in which the computer program or a digital signal including the computer program is recorded. Further, the present disclosure may be the digital signal recorded in these recording media.

Moreover, the present disclosure may be realized by transmitting a computer program or a digital signal including the computer program via an electric communication channel, a wire or wired communication channel, a network such as the Internet as a representative, a data broadcast, or the like.

Moreover, the present disclosure may be a computer system including a microprocessor and a memory. The memory stores therein the abovementioned computer program, and the microprocessor operates in accordance with the computer program.

Moreover, the present disclosure may be executed by a separate another computer system, by transferring the program or the digital signal in a state being recorded in the recording medium or transferring the program or the digital signal via the network or the like.

(6) The abovementioned embodiments and modification examples thereof may be combined to one another.

The present disclosure can be used for control of sound waves reproduced from a speaker array.

Moreover, a speaker array system to which the present disclosure is applied is industrial applicable to a sound announcement system, a remote meeting system, and an AV system.

What is claimed is:

1. An area-sound reproduction system, comprising:

a speaker array including a plurality of speakers linearly arranged side by side;

a sound collector configured to collect an environment sound in an environment where the area-sound reproduction system is installed;

a processor; and a memory having a computer program stored thereon, the computer program causing the processor to execute operations, including adjusting signals that the plurality of speakers are caused to output as reproduced sounds according to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, adjusting signals to be output as the reproduced sounds, such that at each frequency, a sound pressure of the reproduced sound reaching the non-reproduction line on the control line does not exceed the noise level, and removing a frequency component in which the sound pressure of the reproduced sound reaching the non-reproduction line exceeds the noise level.

2. The area-sound reproduction system according to claim 1, wherein the operations further include receiving change in a sound volume of the reproduced sound reaching the reproduction line, and removing a frequency component in which the sound pressure of the reproduced sound reaching the non-reproduction line exceeds the noise level by the change in the sound volume of the reproduced sound.

3. The area-sound reproduction system according to claim 1, wherein the sound collector includes a microphone that is mounted in a terminal used by a user of the area-sound reproduction system.

4. The area-sound reproduction system according to claim 1, wherein the operations further include acquiring position information related to a position of a person from a sensor that is included in the area-sound reproduction system or externally provided, and setting the control line based on the position information.

5. An area-sound reproduction system, comprising:

a speaker array including a plurality of speakers linearly arranged side by side;

a sound collector configured to collect an environment sound in an environment where the area-sound reproduction system is installed;

a processor; and a memory having a computer program stored thereon, the computer program causing the processor to execute operations, including adjusting signals that the plurality of speakers are caused to output as reproduced sounds according to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, and adjusting signals to be output as the reproduced sounds, such that at each frequency, a sound pressure of the reproduced sound reaching the non-reproduction line on the control line does not exceed the noise level, wherein the operations further include at each frequency, when the sound pressure of the reproduced sound reaching the non-reproduction line exceeds the noise level, adjusting a width of the reproduction line, the sound pressure of the reproduced sound reaching the non-reproduction line does not exceed the noise level.

6. The area-sound reproduction system according to claim 5, wherein the sound collector includes a microphone that is mounted in a terminal used by a user of the area-sound reproduction system.

7. The area-sound reproduction system according to claim 5, wherein the operations further include acquiring position information related to a position of a person from a sensor that is included in the area-sound reproduction system or externally provided, and setting the control line based on the position information.

8. An area-sound reproduction system, comprising:

a speaker array including a plurality of speakers linearly arranged side by side;

a sound collector configured to collect an environment sound in an environment where the area-sound reproduction system is installed;

a processor; and a memory having a computer program stored thereon, the computer program causing the processor to execute operations, including adjusting signals that the plurality of speakers are caused to output as reproduced sounds according to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, and adjusting signals to be output as the reproduced sounds, such that at each frequency, a sound pressure of the reproduced sound reaching the non-reproduction line on the control line does not exceed the noise level, wherein the operations further include at each frequency, when the sound pressure of the reproduced sound reaching the non-reproduction line exceeds the noise level, synthesizing a masking sound reaching the non-reproduction line into the reproduced sound reaching the non-reproduction line, a sound pressure of the masking sound exceeds the sound pressure of the reproduced sound.

9. The area-sound reproduction system according to claim 8, wherein the masking sound is the environment sound collected by the sound collector.

10. The area-sound reproduction system according to claim 8, wherein the masking sound is a background music used in the environment where the area-sound reproduction system is installed.

11. The area-sound reproduction system according to claim 8, wherein the sound collector includes a microphone that is mounted in a terminal used by a user of the area-sound reproduction system.

12. The area-sound reproduction system according to claim 8, wherein the operations further include acquiring position information related to a position of a person from a sensor that is included in the area-sound reproduction system or externally provided, and setting the control line based on the position information.

13. An area-sound reproduction method of an area-sound reproduction system, including a speaker array including a plurality of speakers linearly arranged side by side, the area-sound reproduction method comprising:

collecting an environment sound in an environment where the area-sound reproduction system is installed;

adjusting signals that the plurality of speakers are caused to output as reproduced sounds accordingly to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, adjusting signals to be output as the reproduced sounds, such that at each frequency, a sound pressure of the reproduced sound reaching the non-reproduction line on the control line does not exceed the noise level, and removing a frequency component in which the sound pressure of the reproduced sound reaching the non-reproduction line exceeds the noise level.

14. An area-sound reproduction method of an area-sound reproduction system that includes a speaker array, including a plurality of speakers linearly arranged side by side, the area-sound reproduction method comprising:

collecting an environment sound in an environment where the area-sound reproduction system is installed;

adjusting signals that the plurality of speakers are caused to output as reproduced sounds according to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, and adjusting signals to be output as the reproduced sounds, such that at each frequency, a sound pressure of the reproduced sound reaching the non-reproduction line on the control line does not exceed the noise level, and wherein the operations further include at each frequency, when the sound pressure of the reproduced sound reaching the non-reproduction line exceeds the noise level, adjusting a width of the reproduction line, the sound pressure of the reproduced sound reaching the non-reproduction line does not exceed the noise level.

15. An area-sound reproduction method of an area-sound reproduction system that includes a speaker array, including a plurality of speakers linearly arranged side by side, the area-sound reproduction method comprising:

collecting an environment sound in an environment where the area-sound reproduction system is installed;

adjusting signals that the plurality of speakers are caused to output as reproduced sounds according to a reproduction condition on a control line, wherein the control line includes (i) a reproduction line in which sound waves emitted from the speaker array have constructive interference with each other, and (ii) a non-reproduction line in which the sound waves have destructive interference with each other, and causing the plurality of speakers to output the reproduced sounds, wherein the adjusting further includes determining a noise level from the collected environment sound, and adjusting signals to be output as the reproduced sounds, such that at each frequency, a sound pressure of the reproduced sound reaching the non-reproduction line on the control line does not exceed the noise level, and wherein the operations further include at each frequency, when the sound pressure of the reproduced sound reaching the non-reproduction line exceeds the noise level, synthesizing a masking sound reaching the non-reproduction line into the reproduced sound reaching the non-reproduction line, a sound pressure of the masking sound exceeds the sound pressure of the reproduced sound.

* * * * *